US008603721B2

(12) United States Patent
Debies et al.

(10) Patent No.: US 8,603,721 B2
(45) Date of Patent: Dec. 10, 2013

(54) METHOD FOR PREPARING TONER CONTAINING CARBON BLACK PIGMENT WITH LOW SURFACE SULFUR LEVELS

(75) Inventors: Thomas P Debies, Webster, NY (US); Timothy L Lincoln, Rochester, NY (US); Kevin F Marcell, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 279 days.

(21) Appl. No.: 13/081,090

(22) Filed: Apr. 6, 2011

(65) Prior Publication Data

US 2012/0258396 A1 Oct. 11, 2012

(51) Int. Cl.
*G03G 9/09* (2006.01)

(52) U.S. Cl.
USPC ..... 430/137.14; 430/108.9; 430/137.1

(58) Field of Classification Search
USPC ..... 430/108.9, 137.1, 137.14
See application file for complete search history.

(56) References Cited

U.S. PATENT DOCUMENTS

2009/0208864 A1 8/2009 Zhou et al.
2009/0246680 A1 10/2009 Chung et al.

FOREIGN PATENT DOCUMENTS

JP 02-71276 * 3/1990

OTHER PUBLICATIONS

Japanese Patent Office English-language abstract describing Japanese Patent 02-71276, copyright 1990.*
Derwent abstract, ACC.No. 1990-134405, Derwent-Week 199018, describing Japanese Patent 02-71276.*

* cited by examiner

*Primary Examiner* — Janis L Dote
(74) *Attorney, Agent, or Firm* — Judith L. Byorick

(57) ABSTRACT

Disclosed is a process for preparing toner particles which comprises: (a) selecting a carbon black; (b) measuring the surface level of sulfur of the carbon black by X-ray Photoelectron Spectroscopy to ensure that the surface level of sulfur is no more than about 0.05 atomic percent; and (c) mixing the carbon black with a resin to generate a toner composition.

14 Claims, No Drawings

METHOD FOR PREPARING TONER CONTAINING CARBON BLACK PIGMENT WITH LOW SURFACE SULFUR LEVELS

BACKGROUND

Disclosed herein are processes for preparing toner compositions. More specifically, disclosed herein are processes for preparing toners with carbon black having low atomic percent values of sulfur.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. Toner typically comprises a resin and a colorant. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Numerous processes are within the purview of those skilled in the art for the preparation of toners. Emulsion aggregation (EA) is one such method. Emulsion aggregation toners can be used in forming print and/or xerographic images. Emulsion aggregation techniques can entail the formation of an emulsion latex of the resin particles by heating the resin, using emulsion polymerization, as disclosed in, for example, U.S. Pat. No. 5,853,943, the disclosure of which is totally incorporated herein by reference. Other examples of emulsion/aggregation/coalescing processes for the preparation of toners are illustrated in, for example, U.S. Pat. Nos. 5,278,020, 5,290,654, 5,302,486, 5,308,734, 5,344,738, 5,346,797, 5,348,832, 5,364,729, 5,366,841, 5,370,963, 5,403,693, 5,405,728, 5,418,108, 5,496,676, 5,501,935, 5,527,658, 5,585,215, 5,650,255, 5,650,256, 5,723,253, 5,744,520, 5,747,215, 5,763,133, 5,766,818, 5,804,349, 5,827,633, 5,840,462, 5,853,944, 5,863,698, 5,869,215, 5,902,710; 5,910,387; 5,916,725; 5,919,595; 5,925,488, 5,977,210, 5,994,020, 6,576,389, 6,617,092, 6,627,373, 6,638,677, 6,656,657, 6,656,658, 6,664,017, 6,673,505, 6,730,450, 6,743,559, 6,756,176, 6,780,500, 6,830,860, 7,029,817, 7,459,258, 7,547,499, and U.S. Patent Publication Nos. 2007/0141494, 2008/0107989, 2009/0246680, 2009/0208864, and 2011/0028620, the disclosures of each of which are totally incorporated herein by reference.

Polyester EA ultra low melt (ULM) toners have been prepared utilizing amorphous and crystalline polyester resins as disclosed in, for example, U.S. Pat. No. 7,547,499, the disclosure of which is totally incorporated herein by reference.

Two exemplary emulsion aggregation toners include acrylate based toners, such as those based on styrene acrylate toner particles as illustrated in, for example, U.S. Pat. No. 6,120,967, and polyester toner particles, as disclosed in, for example, U.S. Pat. Nos. 5,916,725 and 7,785,763 and U.S. Patent Publication 2008/0107989, the disclosures of each of which are totally incorporated herein by reference.

Black toners are pigmented polymer composites that employ enough carbon black as the pigment to yield an image with the desired image characteristic after transfer and fusing. The morphology and properties of the carbon black can influence color and electrical charging characteristics. These properties in turn can depend on the uniformity of dispersion of the carbon black in the toner. In emulsion aggregation toners carbon black is dispersed in a liquid phase and then incorporated into the polymer through an aggregation process. There is no mechanical dispersion of the pigment, and yet the carbon black remains dispersed in phases that are chemically different; the amount of shear that can be applied in mixing the toner components is relatively low in an extruder. Accordingly, hydrophilic surface components on carbon black, such as sulfates and the like, inhibit uniform mixing of the carbon black with hydrophobic polymer components.

Carbon black is manufactured via thermal decomposition of hydrocarbons, which are frequently obtained from petroleum feedstocks. Sulfur and sulfur-derived components are common surface contaminants in petroleum-derived carbon blacks. Carbon black comprises spherical particles of elemental carbon fused into aggregates. Manufacturers control the size of the aggregates. Carbon blacks for toner applications balance primary particle size and structure to control color properties, ease of dispersion, and controlled electrical resistivity to allow for the design of charging characteristics. The manufacturers have developed their own proprietary chemical modifications in some cases to alter the surface chemistry of the pigment.

While known compositions and processes are suitable for their intended purposes, a need remains for toners with more reproducible charging characteristics. In addition, a need remains for toners containing carbon blacks containing lower levels of surface contaminants that affect charging characteristics. Further, a need remains for methods of measuring the levels of surface contaminants on carbon blacks used in toners. Additionally, a need remains for toners containing carbon blacks with lower levels of sulfur-containing surface contaminants. There is also a need for toners for which the charge can be stabilized across different temperature and humidity zones.

SUMMARY

Disclosed herein is a process for preparing toner particles which comprises: (a) selecting a carbon black; (b) measuring the surface level of sulfur of the carbon black by X-ray Photoelectron Spectroscopy to ensure that the surface level of sulfur is no more than about 0.05 atomic percent; and (c) mixing the carbon black with a resin to generate a toner composition.

DETAILED DESCRIPTION

The carbon black suitable for use in the toners disclosed herein desirably has relatively low levels of sulfur-containing contaminants on the surface thereof. Ideally, the level of sulfur-containing contaminants on the surface is 0 atomic percent. In one embodiment, the carbon black has no more than about 0.05 atomic percent sulfur, in another embodiment no more than about 0.04 atomic percent sulfur, in yet another embodiment no more than about 0.03 atomic percent sulfur, and in still another embodiment no more than about 0.02 atomic percent sulfur, and in another embodiment no more than about 0.01 atomic percent sulfur, although the amount can be outside of these ranges.

The surface level of sulfur can be measured by X-ray Photoelectron Spectroscopy (XPS), a surface analysis technique that provides elemental, chemical state, and quantitative analyses. By measuring the surface level of sulfur on the carbon black prior to use, one can determine whether the level is suitable for use in the toners disclosed herein.

The carbon black suitable for the toners disclosed herein can have any desired or suitable particle size, in one embodiment at least 100 nanometers, and in another embodiment at least about 120 nm, and in one embodiment no more than about 300 nm, and in another embodiment no more than about 200 nm, although the particle size can be outside of these ranges. Particle size here refers to volume average diameter as measured using a measuring instrument such as a BECKMAN COULTER MULTISIZER 3, operated in accordance with the manufacturer's instructions. Representative sampling can occur as follows: a small amount of toner sample, about 1 gram, can be obtained and filtered through a 25 micrometer screen, then put in isotonic solution to obtain a concentration of about 10%, with the sample then run in a BECKMAN COULTER MULTISIZER 3.

The carbon black is present in the toner in any desired or effective amount, in one embodiment at least about 1 percent by weight of the toner, and in another embodiment at least about 2 percent by weight of the toner, and in one embodiment no more than about 25 percent by weight of the toner, and in another embodiment no more than about 15 percent by weight of the toner, although the amount can be outside of these ranges.

If desired, other colorants, such as pigments, dyes, or mixtures thereof can also be present in the toner along with the carbon black.

While not desiring to be limited to any particular theory, it is believed that by providing carbon black with low and reproducible levels of sulfur-containing contaminants on the surface thereof, the toner containing the carbon black can, in some embodiments, have more reproducible triboelectric charging levels from batch to batch, thereby reducing or eliminating the need to vary other additives therein, such as charge additives. In addition, while not desiring to be limited to any particular theory, it is believed that by providing carbon black with low and reproducible levels of sulfur-containing contaminants on the surface thereof, the carbon black can be more readily dispersed in the toner resin, since many sulfur-containing contaminants can attract water to the particle surface, thereby rendering it hydrophilic, while toner resins tend to be hydrophobic. Further, while not desiring to be limited to any particular theory, it is believed that by providing carbon black with low and reproducible levels of sulfur-containing contaminants on the surface thereof and smaller particle size of the carbon black, in some embodiments lower levels of carbon black may be used in the toner.

The toners disclosed herein can be of any desired configuration, such as conventional melt-mixed toners, encapsulated toners, emulsion aggregation toners, or the like. Emulsion aggregation toners will be described herein in more detail; it is to be understood that similar materials can be used in other kinds of toners known in the art and that the toners disclosed herein are not limited to emulsion aggregation toners.

Conventional toners can be prepared by any desired method, including, but not limited to, known methods such as ball milling, spray drying, the Banbury method, extrusion, or the like.

Encapsulated toners can be prepared by any desired method, including, but not limited to, those disclosed in U.S. Pat. Nos. 6,365,312 and 4,937,167, the disclosures of each of which are totally incorporated herein by reference.

Resins

The toners disclosed herein can be prepared from any desired or suitable resins suitable for use in forming a toner. Such resins, in turn, can be made of any suitable monomer or monomers. Suitable monomers useful in forming the resin include, but are not limited to, styrenes, acrylates, methacrylates, butadienes, isoprenes, acrylic acids, methacrylic acids, acrylonitriles, esters, diols, diacids, diamines, diesters, diisocyanates, mixtures thereof, and the like.

Examples of suitable polyester resins include, but are not limited to, sulfonated, non-sulfonated, crystalline, amorphous, combinations thereof, and the like. The polyester resins can be linear, branched, combinations thereof, and the like. Polyester resins can include those resins disclosed in U.S. Pat. Nos. 6,593,049 and 6,756,176, the disclosures of each of which are totally incorporated herein by reference. Suitable resins also include mixtures of amorphous polyester resins and crystalline polyester resins as disclosed in U.S. Pat. No. 6,830,860, the disclosure of which is totally incorporated herein by reference.

Other examples of suitable polyesters include those formed by reacting a diol with a diacid or diester in the presence of an optional catalyst. For forming a crystalline polyester, suitable organic diols include, but are not limited to, aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol can be selected in any desired or effective amount, in one embodiment at least about 40 mole percent, in another embodiment at least about 42 mole percent and in yet another embodiment at least about 45 mole percent, and in one embodiment no more than about 60 mole percent, in another embodiment no more than about 55 mole percent, and in yet another embodiment no more than about 53 mole percent, and the alkali sulfo-aliphatic diol can be selected in any desired or effective amount, in one embodiment 0 mole percent, and in another embodiment no more than about 1 mole percent, and in one embodiment no more than about 10 mole percent, and in another embodiment no more than from about 4 mole percent of the resin, although the amounts can be outside of these ranges.

Examples of suitable organic diacids or diesters for preparation of crystalline resins include, but are not limited to, oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and the like, as well as combinations thereof. The organic diacid can be selected in any desired or effective amount, in one embodiment at least about 40 mole percent, in another embodiment at least about 42 mole percent, and in yet another embodiment at least about 45 mole percent, and in one embodiment no more than about 60 mole percent, in another embodiment no more than about 55 mole percent, and in yet another embodiment no more than about 53 mole percent, although the amounts can be outside of these ranges.

Examples of suitable crystalline resins include, but are not limited to, polyesters, polyamides, polyimides, polyolefins, polyethylene, polybutylene, polyisobutyrate, ethylene-propylene copolymers, ethylene-vinyl acetate copolymers, polypropylene, and the like, as well as mixtures thereof. Specific crystalline resins can be polyester based, such as poly(ethylene-adipate), poly(propylene-adipate), poly(butyleneadipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and the like, as well as mixtures thereof. The crystalline resin can be present in any desired or effective amount, in one embodiment at least about 5 percent by weight of the toner components, and in another embodiment at least about 10 percent by weight of the toner components, and in one embodiment no more than about 50 percent by weight of the toner components, and in another embodiment no more than about 35 percent by weight of the toner components, although the amounts can be outside of these ranges. The crystalline resin can possess any desired or effective melting point, in one embodiment at least about 30° C., and in another embodiment at least about 50° C., and in one embodiment no more than about 120° C., and in another embodiment no more than about 90° C., although the melting point can be outside of these ranges. The crystalline resin can have any desired or effective number average molecular weight (Mn), as measured by gel permeation chromatography (GPC), in one embodiment at least about 1,000, in another embodiment at least about 2,000, and in one embodiment no more than about 50,000, and in another embodiment no more than about 25,000, although the Mn can be outside of these ranges, and any desired or effective weight average molecular weight (Mw), in one embodiment at least about 2,000, and in another embodiment at least about 3,000, and in one embodiment no more than about 100,000, and in another embodiment no more than about 80,000, although the Mw can be outside of these ranges, as determined by Gel Permeation Chromatography using polystyrene standards. The molecular weight distribution (Mw/Mn) of the crystalline resin can be of any desired or effective number, in one embodiment at least about 2, and in another embodiment at least about 3, and in one embodiment no more than about 6, and in another embodiment no more than about 4, although the molecular weight distribution can be outside of these ranges.

Examples of suitable diacid or diesters for preparation of amorphous polyesters include, but are not limited to, dicarboxylic acids, anhydrides, or diesters, such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and the like, as well as mixtures thereof. The organic diacid or diester can be present in any desired or effective amount, in one embodiment at least about 40 mole percent, in another embodiment at least about 42 mole percent, and in yet another embodiment at least about 45 mole percent, and in one embodiment no more than about 60 mole percent, in another embodiment no more than about 55 mole percent, and in yet another embodiment no more than about 53 mole percent of the resin, although the amounts can be outside of these ranges.

Examples of suitable diols for generating amorphous polyesters include, but are not limited to, 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene glycol, and the like, as well as mixtures thereof. The organic diol can be present in any desired or effective amount, in one embodiment at least about 40 mole percent, in another embodiment at least about 42 mole percent, and in yet another embodiment at least about 45 mole percent, and in one embodiment no more than about 60 mole percent, in another embodiment no more than about 55 mole percent, and in yet another embodiment no more than about 53 mole percent of the resin, although the amounts can be outside of these ranges.

Polycondensation catalysts which can be used for preparation of either the crystalline or the amorphous polyesters include, but are not limited to, tetraalkyl titanates such as titanium (iv) butoxide or titanium (iv) iso-propoxide, dialkyltin oxides such as dibutyltin oxide, tetraalkyltins such as dibutyltin dilaurate, dialkyltin oxide hydroxides such as butyltin oxide hydroxide, aluminum alkoxides, alkyl zinc, dialkyl zinc, zinc oxide, stannous oxide, and the like, as well as mixtures thereof. Such catalysts can be used in any desired or effective amount, in one embodiment at least about 0.001 mole percent, and in one embodiment no more than about 5 mole percent based on the starting diacid or diester used to generate the polyester resin, although the amounts can be outside of these ranges.

Examples of suitable amorphous resins include polyesters, polyamides, polyimides, polyolefins, polyethylene, polybutylene, polyisobutyrate, ethylene-propylene copolymers, ethylene-vinyl acetate copolymers, polypropylene, and the like, as well as mixtures thereof. Specific examples of amorphous resins which can be used include, but are not limited to, poly(styrene-acrylate) resins, crosslinked, for example, from about 10 percent to about 70 percent, poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly(styrene-butadiene) resins, and the like, as well as mixtures thereof. Alkali sulfonated polyester resins can be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), and the like, as well as mixtures thereof.

Unsaturated polyester resins can also be used. Examples of such resins include those disclosed in U.S. Pat. No. 6,063,827, the disclosure of which is totally incorporated herein by reference. Exemplary unsaturated polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and the like, as well as mixtures thereof.

One specific suitable amorphous polyester resin is a poly (propoxylated bisphenol A co-fumarate) resin having the following formula:

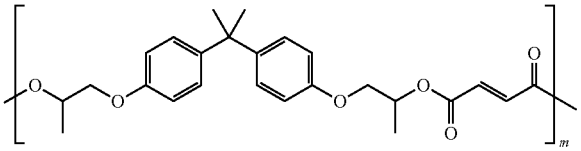

wherein m can be from about 5 to about 1000, although m can be outside of this range. Examples of such resins and processes for their production include those disclosed in U.S. Pat. No. 6,063,827, the disclosure of which is totally incorporated herein by reference.

Also suitable are the polyester resins disclosed in U.S. Pat. No. 7,528,218, the disclosure of which is totally incorporated herein by reference. Specific examples of suitable resins include (1) the polycondensation products of mixtures of the following diacids:

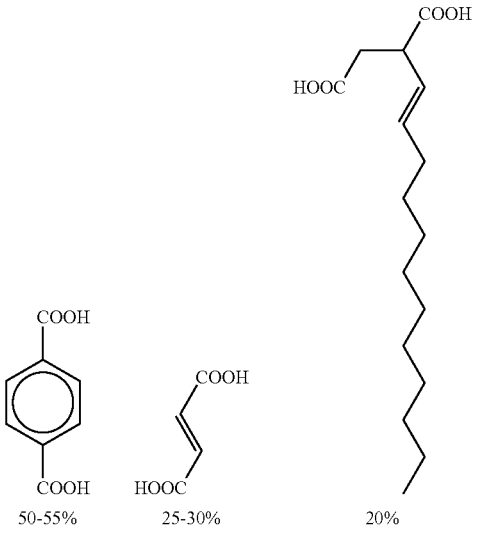

and the following diols:

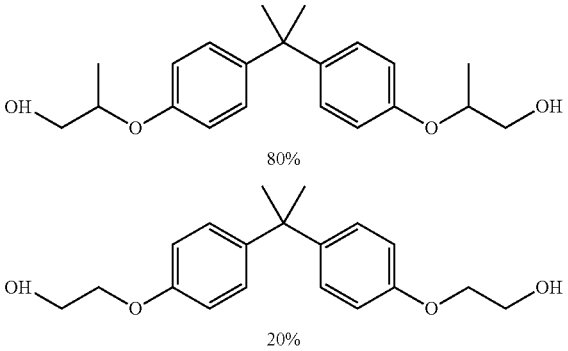

and (2) the polycondensation products of mixtures of the following diacids:

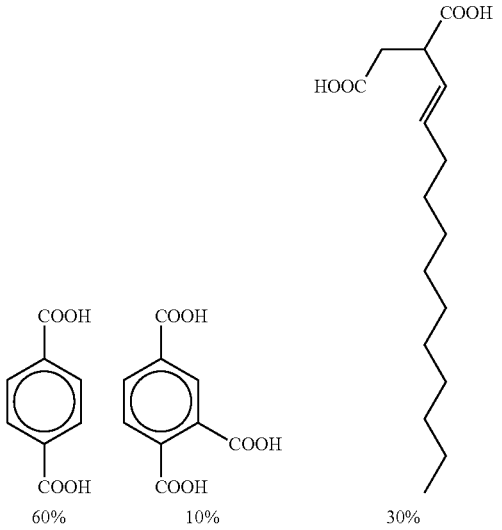

and the following diols:

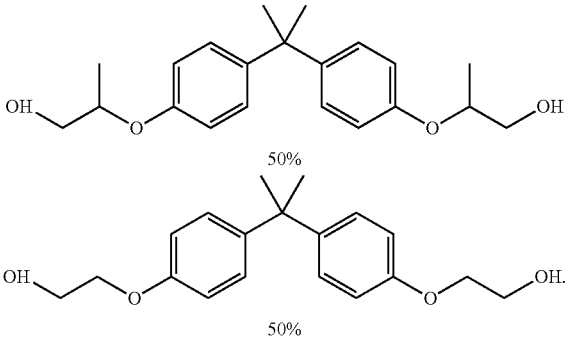

One example of a linear propoxylated bisphenol A fumarate resin which can be used as a latex resin is available under the trade name SPARII from Resana S/A Industrias Quimicas, Sao Paulo Brazil. Other propoxylated bisphenol A fumarate resins that can be used and are commercially available include GTUF and FPESL-2 from Kao Corporation, Japan, and EM181635 from Reichhold, Research Triangle Park, N.C., and the like.

Suitable crystalline resins also include those disclosed in U.S. Pat. No. 7,329,476, the disclosure of which is totally incorporated herein by reference. One specific suitable crystalline resin comprises ethylene glycol and a mixture of dodecanedioic acid and fumaric acid co-monomers with the following formula:

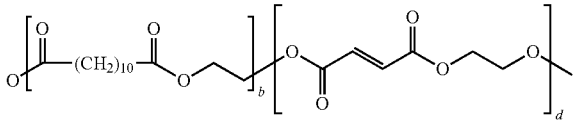

wherein b is from about 5 to about 2000 and d is from about 5 to about 2000, although the values of b and d can be outside of these ranges. Another suitable crystalline resin is of the formula

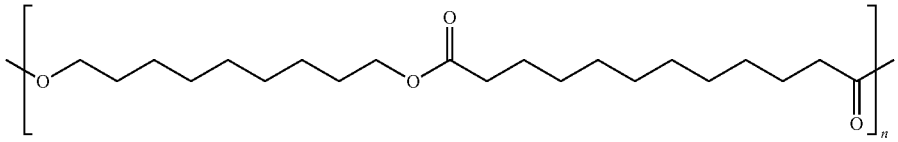

wherein n represents the number of repeat monomer units.

Examples of other suitable latex resins or polymers which can be used include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and the like, as well as mixtures thereof. The polymers can be block, random, or alternating copolymers, as well as combinations thereof.

Emulsification

The emulsion to prepare emulsion aggregation particles can be prepared by any desired or effective method, such as a solventless emulsification method or phase inversion process as disclosed in, for example, U.S. Patent Publications 2007/0141494 and 2009/0208864, the disclosures of each of which are totally incorporated herein by reference. As disclosed in 2007/0141494, the process includes forming an emulsion comprising a disperse phase including a first aqueous composition and a continuous phase including molten one or more ingredients of a toner composition, wherein there is absent a toner resin solvent in the continuous phase; performing a phase inversion to create a phase inversed emulsion comprising a disperse phase including toner-sized droplets comprising the molten one or more ingredients of the toner composition and a continuous phase including a second aqueous composition; and solidifying the toner-sized droplets to result in toner particles. As disclosed in 2009/0208864, the process includes melt mixing a resin in the absence of a organic solvent, optionally adding a surfactant to the resin, optionally adding one or more additional ingredients of a toner composition to the resin, adding to the resin a basic agent and water, performing a phase inversion to create a phase inversed emulsion including a disperse phase comprising toner-sized droplets including the molten resin and the optional ingredients of the toner composition, and solidifying the toner-sized droplets to result in toner particles.

Also suitable for preparing the emulsion is the solvent flash method, as disclosed in, for example, U.S. Pat. No. 7,029,817, the disclosure of which is totally incorporated herein by reference. As disclosed therein, the process includes dissolving the resin in a water miscible organic solvent, mixing with hot water, and thereafter removing the organic solvent from the mixture by flash methods, thereby forming an emulsion of the resin in water. The solvent can be removed by distillation and recycled for future emulsifications.

Any other desired or effective emulsification process can also be used. In one specific embodiment, the resin is a polyester and is prepared by a continuous, organic-solventless emulsification process as disclosed in, for example, U.S. Patent Publications 2009/0208864 and 2009/0246680, the disclosures of each of which are totally incorporated herein by reference. The process entails melt mixing a resin in the absence of an organic solvent, optionally adding a surfactant to the resin, and adding to the resin a basic agent and water to form an emulsion of resin particles. In a more specific embodiment, the process entails providing at least one polyester resin possessing at least one acid group in a reaction vessel; neutralizing the at least one acid group by contacting the resin with a base; emulsifying the neutralized resin by contacting the neutralized resin with at least one surfactant in the absence of an organic solvent to provide a latex emulsion containing latex particles; and continuously recovering the latex particles; and mixing the carbon black with the polyester latex particles by an emulsion aggregation process to generate a toner composition. As used herein, "the absence of an organic solvent" and "organic-solventless" mean that organic solvents are not used to dissolve the polyester resin for emulsification. However, it is to be understood that minor amounts of such solvents may be present in such resins as a consequence of their use in the process of forming the resin.

In this embodiment, the polyester resin can possess acid groups, which can be present at the terminal ends of the resin. Acid groups which may be present include carboxylic acid groups, carboxylic anhydrides, carboxylic acid salts, and the like, as well as mixtures thereof. The number of carboxylic acid groups can be controlled by adjusting the materials used to form the resin and reaction conditions.

The resin can be melt-mixed at an elevated temperature, and base or basic agent can be added thereto. The base can be a solid or added in the form of an aqueous solution. The basic agent is used to neutralize acid groups in the resins, so a basic agent herein may also be referred to as a "basic neutralization agent." Any suitable basic neutralization reagent can be used. In specific embodiments, suitable basic neutralization agents include both inorganic and organic basic agents. Examples of suitable basic agents include ammonium hydroxide, potassium hydroxide, sodium hydroxide, sodium carbonate, sodium bicarbonate, lithium hydroxide, potassium carbonate, organoamines such as triethyl amine, triethanolamine, pyridine and its derivatives, diphenylamine and its derivatives, poly(ethylene amine), and the like, as well as mixtures thereof.

If desired, melt-mixing can occur in an extruder as disclosed in, for example, U.S. Patent Publication 2009/0246680.

Using the basic neutralization agent in combination with a resin possessing acid groups, a neutralization ratio of in one embodiment at least about 50%, and in another embodiment at least about 70%, and in one embodiment no more than about 300%, and in another embodiment no more than about 200%, although the value can be outside of these ranges, can be achieved. In specific embodiments, the neutralization ratio may be calculated using the following equation:

Neutralization ratio in an equivalent amount of [10% $NH_3$/resin(g)]/[resin acid value/0.303*100]

The addition of the basic neutralization agent can thus raise the pH of an emulsion including a resin possessing acid groups to in one embodiment at least about 5, and in another embodiment at least about 6, and in one embodiment no more than about 11, and in another embodiment no more than about 9, and in yet another embodiment no more than about 8, although the value can be outside of these ranges. The neutralization of the acid groups can, in some embodiments, enhance formation of the emulsion.

After neutralization, the hydrophilicity, and thus the emulsifiability of the resin, may be improved when compared with a resin that did not undergo such neutralization process. The degree of neutralization may be controlled, in some embodiments, by the concentration of the base solution added and the feeding rate of the base solution. When an extruder is used, in some embodiments, a base solution can be at a concentration of in one embodiment at least about 1% by weight, and in another embodiment at least about 2% by weight, and in one embodiment no more than about 20% by weight, and in another embodiment no more than about 2% by weight, although the value can be outside of these ranges, with the rate of addition of the base solution into the extruder being in one embodiment at least about 10 grams per minute, and in another embodiment at least about 11.25 grams per minute, and in one embodiment no more than about 50 grams per minute, and in another embodiment no more than about 11.25 grams per minute, although the value can be outside of these ranges. The resulting partially neutralized melt resin can be at a pH of in one embodiment at least about 8, and in another embodiment at least about 11, and in one embodiment no more than about 13, and in another embodiment no more than about 12, although the value can be outside of these ranges.

Suitable stabilizers which can be added at this emulsification stage as emulsifying agents include any surfactant suitable for use in forming a latex resin. Surfactants which can be used during the emulsification stage in preparing latexes with the processes disclosed herein include anionic, cationic, and/or nonionic surfactants. Examples of suitable cationic, anionic, and nonionic surfactants are set forth hereinbelow with respect to toners.

The process includes melt mixing a resin at an elevated temperature, wherein an organic solvent is not utilized in the process. More than one resin can be used in forming the aqueous emulsion. The resin can be an amorphous resin, a crystalline resin, or a combination thereof. In some embodiments, the resin can be an amorphous resin and the elevated temperature is a temperature above the glass transition temperature of the resin. In other embodiments, the resin can be a crystalline resin and the elevated temperature is a temperature above the melting point of the resin. In further embodiments, the resin can be a mixture of amorphous and crystalline resins and the temperature is above the glass transition temperature of the mixture.

Thus, in some embodiments, the process of making the aqueous emulsion includes heating at least one resin to an elevated temperature, stirring the mixture, and, while maintaining the temperature at the elevated temperature, metering aqueous alkaline solution, optional surfactant, and/or water into the mixture until phase inversion occurs to form a phase inversed aqueous emulsion.

In some embodiments, a surfactant can be added to the one or more ingredients of the resin composition before, during, or after melt-mixing, thereby enhancing formation of the phase inversed emulsion. In some embodiments, a surfactant can be added before, during, or after the addition of the basic agent. In some embodiments, the surfactant can be added prior to the addition of the basic agent. In other embodiments, water can be subsequently added in forming the emulsion. The addition of aqueous alkaline solution, optional surfactant, and/or water forms an emulsion including a disperse phase possessing droplets of the surfactant and/or water composition and a continuous phase including the molten ingredients of the resin.

In some embodiments, a phase inversed emulsion can be formed. Phase inversion can be accomplished by continuing to add the aqueous alkaline solution, optional surfactant, and/or water compositions to create a phase inversed emulsion including a disperse phase including droplets possessing the molten ingredients of the resin composition and a continuous phase including the surfactant and/or water composition.

In some embodiments, the process can include heating one or more ingredients of a resin composition to an elevated temperature, stirring the resin composition, and, while maintaining the temperature at the elevated temperature, adding the base, optionally in an aqueous alkaline solution, and optional surfactant into the mixture to enhance formation of the emulsion including a disperse phase and a continuous phase including the resin composition, and continuing to add the aqueous alkaline solution and optional surfactant until phase inversion occurs to form the phase inversed emulsion.

In the above-mentioned heating, the heating to an elevated temperature be to in one embodiment at least about 30° C., in another embodiment at least 50° C., and in another embodiment at least about 70° C., and in one embodiment no more than about 300° C., in another embodiment no more than about 200° C., and in yet another embodiment no more than about 150° C., although the temperature can be outside of these ranges. The heating need not be held at a constant temperature, but can be varied. For example, the heating can be slowly or incrementally increased during heating until a desired temperature is achieved.

While the temperature is maintained in the aforementioned range, the aqueous alkaline composition and optional surfactant can be metered into the heated mixture at least until phase inversion is achieved. In other embodiments, the aqueous alkaline composition and optional surfactant can be metered into the heated mixture, followed by the addition of an aqueous solution, in embodiments deionized water, until phase inversion is achieved.

Stirring can be used to enhance formation of the phase inversed emulsion. Any suitable stirring device can be used. The stirring need not be at a constant speed, but can be varied. For example, as the heating of the mixture becomes more uniform, the stirring rate can be increased. In some embodiments, the stirring can be at in one embodiment at least about 10 rpm, in another embodiment at least about 20 rpm, and in yet another embodiment at least about 50 rpm, and in one embodiment no more than about 5,000 rpm, in another embodiment no more than about 2,000 rpm, and in yet another embodiment no more than about 1,000 rpm, although the value can be outside these ranges. In some embodiments, a homogenizer (that is, a high shear device), can be used to form the phase inversed emulsion, but in other embodiments, the process can take place without the use of a homogenizer. Where used, a homogenizer can operate at a rate of in one specific embodiment from about 3,000 rpm to about 10,000 rpm.

In specific embodiments, the process can include stirring at a rate of from about 50 rpm to about 200 rpm during heating to the molten state, and stirring at a rate of from about 600 rpm to about 1,000 rpm during the addition of any surfactant and the aqueous alkaline composition to perform the phase inversion.

As noted above, an aqueous alkaline solution can be added to the resin after it has been melt mixed. The addition of an aqueous alkaline solution can be useful, in embodiments, where the resin possesses acid groups. The aqueous alkaline solution can neutralize the acidic groups of the resin, thereby enhancing the formation of the phase-inversed emulsion and formation of particles suitable for use in forming toner compositions.

Prior to addition, the basic neutralization agent can be at any suitable temperature, including room temperature of from about 20° C. to about 25° C., or an elevated temperature, for example, the elevated temperatures mentioned above.

In some embodiments, the basic neutralization agent and optional surfactant can be added at a rate of in one embodiment at least about 0.01%, in another embodiment at least about 0.5%, and in yet another embodiment at least about 1%, and one embodiment no more than about 10%, in another embodiment no more than about 5%, and in yet another embodiment no more than about 4% by weight of the resin every 10 minutes, although the amount can be outside of these ranges. The rate of addition of the basic neutralization agent and optional surfactant need not be constant, but can be varied. Thus, for example, for 700 grams of toner resin, the aqueous alkaline composition and optional surfactant might be added at a rate of in one embodiment from about 0.07 gram to about 70 grams every 10 minutes, in another embodiment from about 3.5 grams to about 35 grams every 10 minutes, and in yet another embodiment from about 7 grams to about 28 grams every 10 minutes.

In some embodiments, where the process further includes adding water after the addition of basic neutralization agent and optional surfactant, the water can be metered into the mixture at a rate of in one embodiment at least about 0.01%, in another embodiment at least about 0.5%, and in yet another embodiment at least about 1%, and in one embodiment no more than about 10%, in another embodiment no more than about 5%, and in yet another embodiment no more than about 4% by weight of the resin every 10 minutes, although the amount can be outside of these ranges. The rate of water addition need not be constant, but can be varied. Thus, for example for a 700 gram mixture of resins and surfactant(s), the water might be added at a rate of in one embodiment from about 0.07 gram to about 70 grams every 10 minutes, in another embodiment embodiments from about 3.5 to about 35 grams every 10 minutes, and in yet another embodiment from about 7 to about 28 grams every 10 minutes.

Although the point of phase inversion may vary depending on the components of the emulsion, the temperature of heating, the stirring speed, and the like, phase inversion may occur when basic neutralization agent, optional surfactant, and optional water has been added so that the resulting resin is present in an amount of in one embodiment at least about 30%, in another embodiment at least about 35%, and in yet another embodiment at least about 40%, and in one embodiment no more than about 70%, in another embodiment no more than about 65%, and in yet another embodiment no more than about 60% by weight of the emulsion, although the amount can be outside of these ranges.

At phase inversion, the resin particles become emulsified and dispersed within the aqueous phase. That is, an oil-in-water emulsion of the resin particles in the aqueous phase is formed. Phase inversion can be confirmed by, for example, measuring via any of the techniques described in, for example, Z. Yang et al., "Preparations of Waterborne Dispersions of Epoxy Resin by the Phase-Inversion Emulsification Technique," *Colloid Polym Sci*, Vol. 278, pp. 1164-1171 (2000), the disclosure of which is totally incorporated herein by reference.

The aqueous emulsion is formed, for example, by a process involving phase inversion. Such method permits the emulsion to be formed at temperatures avoiding premature crosslinking of the resin of the emulsion.

Following phase inversion, additional surfactant, water, and/or aqueous alkaline solution can optionally be added to dilute the phase inversed emulsion, although this addition is not required. Any additional surfactant, water, or aqueous alkaline solution can be added at a more rapid rate than the metered rate above. Following phase inversion, the phase inversed emulsion can be cooled to room temperature.

The emulsified resin particles in the aqueous medium can have a submicron size, for example of about 1 μm or less, in some embodiments about 500 nm or less, in one embodiment at least about 10 nm, in another embodiment at least about 50 nm, and in yet another embodiment at least about 100 nm, and in one embodiment no more than about 500 nm, in another embodiment no more than about 400 nm, in yet another embodiment no more than 300 nm, and in still another embodiment no more than about 200 nm, although the value can be outside of these ranges.

It has been found that these processes can produce emulsified resin particles that retain the same molecular weight properties of the starting resin, in some embodiments bulk or pre-made resin used in forming the emulsion.

In further embodiments, the process also enables producing toner particles without an organic solvent. These embodiments include melt mixing a resin at an elevated temperature in the absence of an organic solvent as discussed above; optionally adding a surfactant either before, during or after melt mixing the resin; optionally adding one or more additional ingredients of a toner composition such as colorant, wax, and other additives; adding a basic agent and water; performing a phase inversion to create a phase inversed emulsion including a disperse phase comprising toner-sized droplets including the molten resin and the optional ingredients of the toner composition; and solidifying the toner-sized droplets to result in toner particles.

In embodiments, the optional additional ingredients of a toner composition including colorant, wax, and other additives may be added before, during or after the melt mixing the resin. The additional ingredients can be added before, during or after the addition of the optional surfactant. In further embodiments, the colorant may be added before the addition of the optional surfactant.

Because the droplets may be toner-sized in the disperse phase of the phase inversed emulsion, in embodiments there may be no need to aggregate the droplets to increase the size thereof prior to solidifying the droplets to result in toner particles. However, such aggregation/coalescence of the droplets is optional and can be employed in embodiments of the present disclosure, including the aggregation/coalescence techniques described in, for example, U.S. Patent Application Publication No. 2007/0088117, the disclosure of which is totally incorporated herein by reference.

Catalyst

In embodiments, the phase inversed emulsion can also have included therein a hardener or catalyst for crosslinking the resin. The catalyst can be a thermal crosslinking catalyst, for example a catalyst that initiates crosslinking at temperatures of, for example, about 160° C. or less such as in one embodiment at least about 50° C., and in another embodiment at least about 100° C., and in one embodiment no more than about 160° C., although the temperature can be outside of these ranges. Examples of suitable crosslinking catalysts (to crosslink for instance an epoxy resin) include, for example, blocked acid catalysts such as available from King Industries under the name NACURE, for example including NACURE SUPER XC-7231 and NACURE XC-AD230. Other known catalysts to initiate crosslinking can also be used, for example including catalysts such as aliphatic amines and alicyclic amines, for example bis(4-aminocyclohexyl)methane, bis (aminomethyl)cyclohexane, m-xylenediamine, and 3,9-bis (3-aminopropyl)-2,4,8,10-tetraspiro[5,5]undecane; aromatic amines, for example metaphenylene diamine, diaminodiphenylmethane, and diaminodiphenyl sulfone; tertiary amines and corresponding salts, for example benzyldimethylamine, 2,4,6-tris(dimethylaminomethyl)phenol, 1,8-diazabicyclo(5,4,0)undecene-7,1,5-diazabicyclo(4,3,0)nonene-7; aromatic acid anhydrides, for example phthalic anhydride, trimellitic anhydride, and pyromellitic anhydride; alicyclic carboxylic anhydrides, for example tetrahydrophthalic anhydride, methyltetrahydrophthalic anhydride, hexahydrophthalic anhydride, methylhexahydrophthalic anhydride, methylendomethylenetetrahydrophthalic anhydride, dodecenylsuccinic anhydride, and trialkyltetrahydrophthalic anhydrides; polyvalent phenols, for example catechol, resorcinol, hydroquinone, bisphenol F, bisphenol A, bisphenol S, biphenol, phenol novolac compounds, cresol novolac compounds, novolac compounds of divalent phenols such as bisphenol A, trishydroxyphenylmethane, aralkylpolyphenols, and dicyclopentadiene polyphenols; imidazoles and salts thereof, for example 2-methylimidazole, 2-ethyl-4-methylimidazole, and 2-phenylimidazole; $BF_3$ complexes of amine; Bronsted acids, for example aliphatic sulfonium salts and aromatic sulfonium salts; dicyandiamide; organic acid hydrazides, for example adipic acid dihydrazide and phthalic acid dihydrazide; resols; polycarboxylic acids, for example adipic acid, sebacic acid, terephthalic acid, trimellitic acid, polyester resins containing carboxylic groups; organic phosphines; and the like, as well as mixtures thereof. The catalyst may be included in any desired or effective amount, in one embodiment at least about 0.01%, in another embodiment at least about 0.05%, and in yet another embodiment at least about 0.1%, and one embodiment no more than about 20%, and in another embodiment no more than about 10% by weight of the phase inversed emulsion, although the amount can be outside of these ranges.

If a catalyst is used, the catalyst can be incorporated into the toner composition by, for instance, melt mixing prior to the phase inversion. In other embodiments, the catalyst can be added to the toner composition subsequent to the phase inversion.

If desired, the polycondensation polymerization process to form a polyester resin and the neutralization process can be continuously performed in an extruder, such as the one illustrated in 2009/0246680. Preheated liquid reagents or a mixture of reagents can be fed into a screw extruder through one or multiple supply ports to enable reactive reagents and substrates to be mixed. The reagents introduced through the supply port include any monomer, acid, diol, surfactant, initiator, seed resin, chain transfer agent, crosslinker, and the like, useful in forming the desired latex. In some embodiments the reaction can take place under an inert gas such as nitrogen. The nitrogen gas flow to the reaction system can prevent oxidation and other side reactions. A condenser can also be attached to the extruder to remove water vapor and nitrogen that is flowing counter current to the reactants. Screw rotation can be at any desired or effective rate, in one embodiment at least about 50 rotations per minute ("rpm"), in another embodiment at least about 250 rpm, and in one embodiment no more than about 1500 rpm, and in another embodiment no more than about 1000 rpm, although the rate can be outside of these ranges.

The liquid reagents, optionally preheated to a temperature of in one embodiment at least about 80° C., and in another embodiment at least about 90° C., and in one embodiment no more than about 140° C., and in another embodiment no more than about 120° C., although the temperature can be outside of these ranges, can be used to form the latex, and can be fed into the extruder through one or multiple feed streams and then mixed in the extruder. The spinning of the extruder screw facilitates both the mixing of the reactants for the polycondensation stage and the travel of the materials through the extruder. The reaction takes place at any desired or effective temperature, in one specific embodiment above about 200° C., and in one embodiment at least about 200° C., in another embodiment at least about 210° C., and in yet another embodiment at least about 225° C., and in one embodiment no more than about 360° C., in another embodiment no more than about 325° C., and in yet another embodiment no more than about 275° C., although the temperature can be outside of these ranges. The desired residence time of the reactants can be achieved through the extruder design and operation, including liquid feed rate and screw speed. In some embodiments, the reactants can reside in the extruder during the polycondensation reaction for a period of from about 1 minute to about 100 minutes, in other embodiments from about 5 minutes to about 30 minutes, although the time can be outside of these ranges.

The liquid reagents can include preformed polyesters or, in some embodiments, reagents used to form the polyester itself, for example, any acid, alcohol, diacid, diol, and the like useful in forming the desired polyester. Thus, where the ester is itself formed in the extruder, the polycondensation reaction stage can be divided into two sub-steps: esterification and polycondensation. In such a case, at the esterification step, reagents may be introduced into the extruder where they undergo esterification in the portion of the extruder closer to the supply port, with polycondensation occurring closer to the end of the extruder closer to the resin exit port.

The rate of polycondensation can be controlled, in part, by controlling the rate of removal of water vapor from the melt, which can result in an increase in the rate of polycondensation. If desired, a slight vacuum can be applied to the system, which, in some embodiments, can increase the rate of the polycondensation reaction.

The end point of the polycondensation reaction can be determined by the desired molecular weight, which correlates to the melt viscosity or acid value of the material. The molecular weight and molecular weight distribution (MWD) can be measured by Gel Permeation Chromatography (GPC). The molecular weight in one embodiment is at least about 3,000 g/mole, in another embodiment at least about 8,000 g/mole, and in yet another embodiment at least about 10,000 g/mole, and in one embodiment no more than about 150,000 g/mole, in another embodiment no more than about 100,000 g/mole, and in yet another embodiment no more than about 90,000 g/mole, although the value can be outside of these ranges.

These values can be obtained by adjusting the rate of polycondensation by controlling the temperature and removing water during the process.

After the polycondensation process is complete, the materials can be cooled to a temperature of in one embodiment from about 90° C. to about 105° C., in another embodiment from about 94° C. to about 100° C., and in another embodiment to about 96° C., and transferred to the next stage for neutralization and emulsification.

While the process to this point has been described as a polycondensation reaction being transferred to a screw extruder for neutralization and emulsification, in other embodiments, a pre-made polyester may be obtained and introduced into the screw extruder for neutralization and emulsification. Thus, where a pre-made polyester is used, the above polycondensation portion of the process of the present disclosure may be omitted.

A suitable system for neutralization and emulsification can include a screw extruder possessing one or multiple supply ports to receive the polycondensation product or, as noted above, any pre-made polyester that has been processed by, for example, melt mixing, neutralization, emulsification and stabilization, combinations thereof, or the like, to obtain small enough particles that can be processed to form toner particles. In specific embodiments a basic neutralization agent can be introduced into the extruder through a supply port for neutralization during the neutralization stage. A stabilizer, such as a surfactant, can be introduced into the extruder through a supply port during the emulsification stage. A condenser can also, if desired, be attached to the extruder to remove water vapor during polycondensation polymerization. Screw rotation speeds can be at any desired or effective rate, in on embodiment at least about 50 rpm, in another embodiment at least about 100 rpm, and in one embodiment no more than about 1500 rpm, and in another embodiment no more than about 1000 rpm, although the rate can be outside of these ranges.

The resulting partially neutralized melt resin can then proceed through the extruder into the emulsification zone, where a preheated emulsifying agent can be added at a controlled rate. As noted above, the process does not require the use of solvents, as the neutralized resin has excellent emulsifiability in the stabilizers or surfactants described herein. In some embodiments, the preheated stabilizer can be added under pressure with nitrogen gas to reduce the cycle time of the process and minimize any polyester crystallization. The temperature under which emulsification proceeds in one embodiment is at least about 20° C. higher than the melting point of the polyester to permit the proper flow of the resin through the extruder and to permit sufficient emulsification of the particles. Suitable temperatures for emulsification will depend upon the polyester resin utilized, and may be in one specific embodiment at least about 80° C., in another embodiment at least about 90° C., and in one embodiment no more than about 180° C., and in another embodiment no more than about 110° C., although the temperature can be outside of these ranges.

The desired amount of time for emulsification can be obtained by modifying such aspects of the system as the extruder design, the speed at which the screw spins, the temperature of the extruder barrels, the feed rate of the resin into the extruder, and the like. The feed rate of resin into the extruder can be in one embodiment at least about 1 pound per hour (lb/hr), and in another embodiment at least about 5 lb/hr, and in one embodiment no more than about 70 lb/hr, and in another embodiment no more than about 10 lb/hr, although the rate can be outside of these ranges. In some embodiments, the resin can reside in the extruder during the neutralization and during the emulsification stage for a period of time from about 30 seconds to about 90 seconds, in other embodiments from about 40 seconds to about 60 seconds, although the time can be outside of these ranges.

The size of the final polyester particles thus produced and their size distribution can be controlled by adjusting the degree of neutralization of the carboxyl groups, the amount of stabilizer added, and residence time of the resin in the neutralization and emulsification stage. In practice, resins produced in accordance with this process have a particle size of in one embodiment from about 30 nm to about 500 nm, in another embodiment from about 40 nm to about 300 nm, although the particle size can be outside of these ranges.

The resulting emulsion can exit the extruder by way of an exit port and may, if desired, be subjected to an optional homogenization step in another screw extruder or any suitable mixing or blending device within the purview of those skilled in the art, for homogenization at a temperature of from in one embodiment from about −10° C. to about 100° C., in another embodiment from about 80° C. to about 95° C. An additional aqueous stabilizer solution can be added to the emulsion during this optional homogenization step to stabilize the polyester particles. The amount of stabilizer can be in one embodiment from about 0.1 to about 10 percent by weight of the final emulsion composition, in another embodiment from about 2 to about 8 percent by weight of the final emulsion composition.

After addition of a neutralizer and surfactants during emulsification as described above, the neutralization and emulsification portions of the process of the present disclosure may be complete and a latex resin obtained as described above.

In addition, in some embodiments, the polyester particles produced can be subjected to sonification to accelerate the formation of particles of a desired nanometer size. Methods for performing such sonification are within the purview of those skilled in the art and include, for example, the application of ultrasound, extrusion, combinations thereof, and similar sources of sound to break up the polyester particles further and to reduce the particle sizes. In some embodiments, sound waves at a frequency of in one embodiment from about 15 kHz to about 25 kHz, in other embodiments from about 17 kHz to about 22 kHz, can be applied to the resin particles for a period of time of in one embodiment from about 5 seconds to about 5 minutes, in another embodiment from about 30 seconds to about 3.5 minutes to produce particles having the desired size.

Toner

The toner particles can be prepared by any desired or effective method. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are totally incorporated herein by reference. Toner compositions and toner particles can be prepared by aggregation and coalescence processes in which small-size resin particles are aggregated to the appropriate toner particle size and then coalesced to achieve the final toner-particle shape and morphology.

Toner compositions can be prepared by emulsion-aggregation processes that include aggregating a mixture of the carbon black, an optional wax, any other desired or required additives, and emulsions including the selected resins described above, optionally in surfactants, and then coalescing the aggregate mixture. A mixture can be prepared by adding the carbon black and optionally a wax or other materials, which can also be optionally in a dispersion(s) including a surfactant, to the emulsion, which can also be a mixture of two or more emulsions containing the resin.

Surfactants

Examples of nonionic surfactants include polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™ IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™. Other examples of suitable nonionic surfactants include a block copolymer of polyethylene oxide and polypropylene oxide, including those commercially available as SYNPERONIC PE/F, such as SYNPERONIC PE/F 108.

Anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ available from Daiichi Kogyo Seiyaku, combinations thereof, and the like. Other suitable anionic surfactants include DOWFAX™ 2A1, an alkyldiphenyloxide disulfonate from Dow Chemical Company, and/or TAYCA POWER BN2060 from Tayca Corporation (Japan), which are branched sodium dodecyl benzene sulfonates. Combinations of these surfactants and any of the foregoing anionic surfactants can be used.

Examples of cationic surfactants, which are usually positively charged, include alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, as well as mixtures thereof.

Wax

Optionally, a wax can also be combined with the resin and other toner components in forming toner particles. When included, the wax can be present in any desired or effective amount, in one embodiment at least about 1 percent by weight, and in another embodiment at least about 5 percent by weight, and in one embodiment no more than about 25 percent by weight, and in another embodiment no more than about 20 percent by weight, although the amount can be outside of these ranges. Examples of suitable waxes include (but are not limited to) those having, for example, a weight average molecular weight of in one embodiment at least about 500, and in another embodiment at least about 1,000, and in one embodiment no more than about 20,000, and in another embodiment no more than about 10,000, although the weight average molecular weight can be outside of these ranges. Examples of suitable waxes include, but are not limited to, polyolefins, such as polyethylene, polypropylene, and polybutene waxes, including those commercially available from Allied Chemical and Petrolite Corporation, for example POLYWAX™ polyethylene waxes from Baker Petrolite, wax emulsions available from Michaelman, Inc. and Daniels Products Company, EPOLENE N-15™ commercially available from Eastman Chemical Products, Inc., and VISCOL 550-P™, a low weight average molecular weight polypropylene available from Sanyo Kasei K. K., and the like; plant-based waxes, such as carnauba wax, rice wax, candelilla wax, sumacs wax, jojoba oil, and the like; animal-based waxes, such as beeswax and the like; mineral-based waxes and petroleum-based waxes, such as montan wax, ozokerite, ceresin, paraffin wax, microcrystalline wax, Fischer-Tropsch wax, and the like; ester waxes obtained from higher fatty acids and higher alcohols, such as stearyl stearate, behenyl behenate, and the like; ester waxes obtained from higher fatty acid and monovalent or multivalent lower alcohols, such as butyl stearate, propyl oleate, glyceride monostearate, glyceride distearate, pentaerythritol tetrabehenate, and the like; ester waxes obtained from higher fatty acids and multivalent alcohol multimers, such as diethyleneglycol monostearate, dipropyleneglycol distearate, diglyceryl distearate, triglyceryl tetrastearate, and the like; sorbitan higher fatty acid ester waxes, such as sorbitan monostearate and the like; and cholesterol higher fatty acid ester waxes, such as cholesteryl stearate and the like; and the like, as well as mixtures thereof. Examples of suitable functionalized waxes include, but are not limited to, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated amide waxes, for example MICROSPERSION 19™ available from Micro Powder Inc., imides, esters, quaternary amines, carboxylic acids or acrylic polymer emulsions, for example JONCRYL 74™, 89™, 130™, 537™, and 538™, all available from SC Johnson Wax, chlorinated polypropylenes and polyethylenes available from Allied Chemical and Petrolite Corporation and SC Johnson wax, and the like, as well as mixtures thereof. Mixtures and combinations of the foregoing waxes can also be used. Waxes can be included as, for example, fuser roll release agents. When included, the wax can be present in any desired or effective amount, in one embodiment at least about 1 percent by weight, and in another embodiment at least about 5 percent by weight, and in one embodiment no more than about 25 percent by weight, and in another embodiment no more than about 20 percent by weight, although the amount can be outside of these ranges.

Toner Preparation

The pH of the resulting mixture can be adjusted by an acid, such as acetic acid, nitric acid, or the like. In specific embodiments, the pH of the mixture can be adjusted to from about 2 to about 4.5, although the pH can be outside of this range. Additionally, if desired, the mixture can be homogenized. If the mixture is homogenized, homogenization can be performed by mixing at from about 600 to about 4,000 revolutions per minute, although the speed of mixing can be outside of this range. Homogenization can be performed by any desired or effective method, for example, with an IKA ULTRA TURRAX T50 probe homogenizer.

Following preparation of the above mixture, an aggregating agent can be added to the mixture. Any desired or effective aggregating agent can be used to form a toner. Suitable aggregating agents include, but are not limited to, aqueous solutions of divalent cations or a multivalent cations. Specific examples of aggregating agents include polyaluminum halides such as polyaluminum chloride (PAC), or the corresponding bromide, fluoride, or iodide, polyaluminum silicates, such as polyaluminum sulfosilicate (PASS), and water soluble metal salts, including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and the like, as well as mixtures thereof. In specific embodiments, the aggregating agent can be added to the mixture at a temperature below the glass transition temperature (Tg) of the resin.

The aggregating agent can be added to the mixture used to form a toner in any desired or effective amount, in one embodiment at least about 0.1 percent by weight, in another embodiment at least about 0.2 percent by weight, and in yet another embodiment at least about 0.5 percent by weight, and in one embodiment no more than about 8 percent by weight, and in another embodiment no more than about 5 percent weight of the resin in the mixture, although the amounts can be outside of these ranges.

To control aggregation and coalescence of the particles, the aggregating agent can, if desired, be metered into the mixture over time. For example, the agent can be metered into the mixture over a period of in one embodiment at least about 5 minutes, and in another embodiment at least about 30 minutes, and in one embodiment no more than about 240 minutes, and in another embodiment no more than about 200 minutes, although more or less time can be used. The addition of the agent can also be performed while the mixture is maintained under stirred conditions, in one embodiment at least about 50 rpm, and in another embodiment at least about 100 rpm, and in one embodiment no more than about 1,000 rpm, and in another embodiment no more than about 500 rpm, although the mixing speed can be outside of these ranges, and, in some specific embodiments, at a temperature that is below the glass transition temperature of the resin as discussed above, in one specific embodiment at least about 30° C., in another specific embodiment at least about 35° C., and in one specific embodiment no more than about 90° C., and in another specific embodiment no more than about 70° C., although the temperature can be outside of these ranges.

The particles can be permitted to aggregate until a predetermined desired particle size is obtained. A predetermined desired size refers to the desired particle size to be obtained as determined prior to formation, with the particle size being monitored during the growth process until this particle size is reached. Samples can be taken during the growth process and analyzed, for example with a COULTER COUNTER, for average particle size. Aggregation can thus proceed by maintaining the elevated temperature, or by slowly raising the temperature to, for example, from about 40° C. to about 100° C. (although the temperature can be outside of this range), and holding the mixture at this temperature for a time from about 0.5 hours to about 6 hours, in embodiments from about hour 1 to about 5 hours (although time periods outside of these ranges can be used), while maintaining stirring, to provide the aggregated particles. Once the predetermined desired particle size is reached, the growth process is halted. In embodiments, the predetermined desired particle size is within the toner particle size ranges mentioned above.

The growth and shaping of the particles following addition of the aggregation agent can be performed under any suitable conditions. For example, the growth and shaping can be conducted under conditions in which aggregation occurs separate from coalescence. For separate aggregation and coalescence stages, the aggregation process can be conducted under shearing conditions at an elevated temperature, for example of from about 40° C. to about 90° C., in embodiments from about 45° C. to about 80° C., which may be below the glass transition temperature of the resin as discussed above.

Shell Formation

An optional shell can then be applied to the formed aggregated toner particles. Any resin described above as suitable for the core resin can be used as the shell resin. The shell resin can be applied to the aggregated particles by any desired or effective method. For example, the shell resin can be in an emulsion, including a surfactant. The aggregated particles described above can be combined with said shell resin emulsion so that the shell resin forms a shell over the formed aggregates. In one specific embodiment, an amorphous polyester can be used to form a shell over the aggregates to form toner particles having a core-shell configuration.

Once the desired final size of the toner particles is achieved, the pH of the mixture can be adjusted with a base to a value in one embodiment of from about 6 to about 10, and in another embodiment of from about 6.2 to about 7, although a pH outside of these ranges can be used. The adjustment of the pH can be used to freeze, that is to stop, toner growth. The base used to stop toner growth can include any suitable base, such as alkali metal hydroxides, including sodium hydroxide and potassium hydroxide, ammonium hydroxide, combinations thereof, and the like. In specific embodiments, ethylene diamine tetraacetic acid (EDTA) can be added to help adjust the pH to the desired values noted above. In specific embodiments, the base can be added in amounts from about 2 to about 25 percent by weight of the mixture, and in more specific embodiments from about 4 to about 10 percent by weight of the mixture, although amounts outside of these ranges can be used.

Coalescence

Following aggregation to the desired particle size, with the formation of the optional shell as described above, the particles can then be coalesced to the desired final shape, the coalescence being achieved by, for example, heating the mixture to any desired or effective temperature, in one embodiment at least about 55° C., and in another embodiment at least about 65° C., and in one embodiment no more than about 100° C., and in another embodiment no more than about 75° C., and in one specific embodiment about 70° C., although temperatures outside of these ranges can be used, which can be below the melting point of the crystalline resin to prevent plasticization. Higher or lower temperatures may be used, it being understood that the temperature is a function of the resins used for the binder.

Coalescence can proceed and be performed over any desired or effective period of time, in one embodiment at least about 0.1 hour, and in another embodiment at least 0.5 hour, and in one embodiment no more than about 9 hours, and in another embodiment no more than about 4 hours, although periods of time outside of these ranges can be used.

After coalescence, the mixture can be cooled to room temperature, typically from about 20° C. to about 25° C. (although temperatures outside of this range can be used). The cooling can be rapid or slow, as desired. A suitable cooling method can include introducing cold water to a jacket around the reactor. After cooling, the toner particles can be optionally washed with water and then dried. Drying can be accomplished by any suitable method for drying including, for example, freeze-drying.

Optional Additives

The toner particles can also contain other optional additives as desired. For example, the toner can include positive or negative charge control agents in any desired or effective amount, in one embodiment in an amount of at least about 0.1 percent by weight of the toner, and in another embodiment at least about 1 percent by weight of the toner, and in one embodiment no more than about 10 percent by weight of the toner, and in another embodiment no more than about 3 percent by weight of the toner, although amounts outside of these ranges can be used. Examples of suitable charge control agents include, but are not limited to, quaternary ammonium compounds inclusive of alkyl pyridinium halides; bisulfates; alkyl pyridinium compounds, including those disclosed in U.S. Pat. No. 4,298,672, the disclosure of which is totally incorporated herein by reference; organic sulfate and sulfonate compositions, including those disclosed in U.S. Pat. No. 4,338,390, the disclosure of which is totally incorporated herein by reference; cetyl pyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the optional shell resin described above or after application of the optional shell resin.

There can also be blended with the toner particles external additive particles, including flow aid additives, which can be present on the surfaces of the toner particles. Examples of these additives include, but are not limited to, metal oxides, such as titanium oxide, silicon oxide, tin oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in one embodiment at least about 0.1 percent by weight of the toner, and in another embodiment at least about 0.25 percent by weight of the toner, and in one embodiment no more than about 5 percent by weight of the toner, and in another embodiment no more than about 3 percent by weight of the toner, although amounts outside these ranges can be used. Suitable additives include, but are not limited to, those disclosed in U.S. Pat. Nos. 3,590,000, 3,800,588, and 6,214,507, the disclosures of each of which are totally incorporated herein by reference. Again, these additives can be applied simultaneously with an optional shell resin described above or after application of an optional shell resin.

The toner particles can be formulated into a developer composition. The toner particles can be mixed with carrier particles to achieve a two-component developer composition. The toner concentration in the developer can be of any desired or effective concentration, in one embodiment at least about 1 percent, and in another embodiment at least about 2 percent, and in one embodiment no more than about 25 percent, and in another embodiment no more than about 15 percent by weight of the total weight of the developer, although amounts outside these ranges can be used.

The toner particles have a circularity of in one embodiment at least about 0.920, in another embodiment at least about 0.940, in yet another embodiment at least about 0.962, and in still another embodiment at least about 0.965, and in one embodiment no more than about 0.999, in another embodiment no more than about 0.990, and in yet another embodiment no more than about 0.980, although the value can be outside of these ranges. A circularity of 1.000 indicates a completely circular sphere. Circularity can be measured with, for example, a SYSMEX FPIA 2100 analyzer.

Emulsion aggregation processes provide greater control over the distribution of toner particle sizes and can limit the amount of both fine and coarse toner particles in the toner. The toner particles can have a relatively narrow particle size distribution with a lower number ratio geometric standard deviation (GSDn) of in one embodiment at least about 1.15, in another embodiment at least about 1.18, and in yet another embodiment at least about 1.20, and in one embodiment no more than about 1.40, in another embodiment no more than about 1.35, in yet another embodiment no more than about 1.30, and in still another embodiment no more than about 1.25, although the value can be outside of these ranges.

The toner particles can have a volume average diameter (also referred to as "volume average particle diameter" or "$D_{50v}$") of in one embodiment at least about 3 μm, in another embodiment at least about 4 μm, and in yet another embodiment at least about 5 μm, and in one embodiment no more than about 25 μm, in another embodiment no more than about 15 μm, and in yet another embodiment no more than about 12 μm, although the value can be outside of these ranges. $D_{50v}$, GSDv, and GSDn can be determined using a measuring instrument such as a BECKMAN COULTER MULTISIZER 3, operated in accordance with the manufacturer's instructions. Representative sampling can occur as follows: a small amount of toner sample, about 1 gram, can be obtained and filtered through a 25 micrometer screen, then put in isotonic solution to obtain a concentration of about 10%, with the sample then run in a BECKMAN COULTER MULTISIZER 3.

The toner particles can have a shape factor of in one embodiment at least about 105, and in another embodiment at least about 110, and in one embodiment no more than about 170, and in another embodiment no more than about 160, SF1*a, although the value can be outside of these ranges. Scanning electron microscopy (SEM) can be used to determine the shape factor analysis of the toners by SEM and image analysis (IA). The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

The characteristics of the toner particles may be determined by any suitable technique and apparatus and are not limited to the instruments and techniques indicated hereinabove.

In embodiments where the toner resin is crosslinkable, such crosslinking can be performed in any desired or effective manner. For example, the toner resin can be crosslinked during fusing of the toner to the substrate when the toner resin is crosslinkable at the fusing temperature. Crosslinking can also be effected by heating the fused image to a temperature at which the toner resin will be crosslinked, for example in a post-fusing operation. In specific embodiments, crosslinking can be effected at temperatures of in one embodiment about 160° C. or less, in another embodiment from about 70° C. to about 160° C., and in yet another embodiment from about 80° C. to about 140° C., although temperatures outside these ranges can be used.

Specific embodiments will now be described in detail. These examples are intended to be illustrative, and the claims are not limited to the materials, conditions, or process parameters set forth in these embodiments. All parts and percentages are by weight unless otherwise indicated.

EXAMPLE I

Carbon blacks obtained from different manufacturers and different suppliers or lot numbers for these manufacturers were analyzed by X-ray Photoelectron Spectroscopy (XPS) for the levels of surface sulfur. The top 2 to 5 nanometers of the sample's surface and a region about 1 millimeter in diameter were analyzed. The sample was presented to the X-ray source by dusting the powders onto copper conductive tape. The limits of detection of the technique were about 0.1 atom percent for the top 2 to 5 nm. The quantitative analyses were precise to within 5% of the measured value for major constituents and 10% of the measured value for minor constituents.

Carbon black samples measured were REGAL 330, CABOT carbon black lot #TPX1067, and CABOT carbon black lot #TPX1337, obtained from Cabot, Billerica, Mass., NIPEX 35, obtained from Evonik Carbon Black GmbH, Rodenbacher, Chaussee 4, Germany, and NIPEX 35, obtained from Evonik Industries, Belpre, Ohio. The results were as follows:

| Sample | Source | Atomic Percent Carbon | Atomic Percent Oxygen | Atomic Percent Sulfur |
|---|---|---|---|---|
| REGAL 330 CB | Cabot | 98.92 | 0.68 | 0.40 |
| NIPEX 35 | Evonik Germany | 99.76 | 0.19 | 0.04 |
| NIPEX 35 | Evonik Ohio | 99.33 | 0.36 | 0.31 |
| TPX1067 | Cabot | 99.15 | 0.57 | 0.28 |
| TPX1337 | Cabot | 99.48 | 0.48 | 0.03 |

As the results indicate, NIPEX 35 obtained from Evonik Germany, with 0.04 atomic percent sulfur, and Cabot TPX1337, with 0.03 atomic percent sulfur, are suitable for use with the toners disclosed herein.

EXAMPLE II

A black emulsion aggregation toner is prepared at the 20 gallon pilot scale (11 g dry theoretical toner). Amorphous polyester emulsion A contains a polyester resin emulsion having a Mw of about 19,400, an Mn of about 5,000, and a Tg onset of about 60° C., and about 35% solids. Amorphous polyester emulsion B contains a polyester resin emulsion having a weight average molecular weight (Mw) of about 86,000, a number average molecular weight (Mn) of about 5,600, an onset glass transition temperature (Tg onset) of about 56° C., and about 35% solids. The crystalline polyester emulsion contains a polyester resin emulsion having a Mw of about 23,300, an Mn of about 10,500, a melting temperature (Tm) of about 71° C., and about 35.4% solids. Both amorphous resins are of the formula

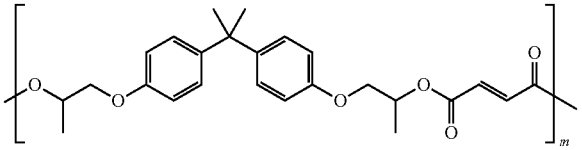

wherein m is from about 5 to about 1000. The crystalline resin is of the formula

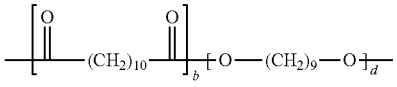

wherein b is from about 5 to about 2000 and d is from about 5 to about 2000. Two amorphous emulsions (7 kg amorphous polyester A and 7 kg amorphous polyester B) containing 2% surfactant (DOWFAX 2A1), 2 kg crystalline emulsion containing 2% surfactant (DOWFAX 2A1), 3 kg wax (IGI), 6 kg NIPEX 35 carbon black available from Evonik Germany, having a surface level of 0.04 atomic percent sulfur as measured by XPS by the method described in Example I, and 917 g cyan pigment (Pigment Blue 15:3 Dispersion, about 17% solids, available from Sun Chemical Corporation) are mixed in the reactor, followed by adjusting the pH to 4.2 using 0.3M nitric acid. The slurry is then homogenized through a cavitron homogenizer with the use of a recirculating loop for a total of 60 minutes where during the first 8 minutes the coagulant, consisting of 2.96 g $Al_2(SO_4)_3$ mixed with 36.5 g deionized water, is added inline. The reactor rpm is increased from 100 rpm to set mixing at 300 rpm once all the coagulant is added. The slurry is then aggregated at a batch temperature of 42° C. During aggregation, a shell comprising the same amorphous emulsions as in the core is pH adjusted to 3.3 with nitric acid and added to the batch. Thereafter the batch is further heated to achieve the targeted particle size. Once at the target particle size with a pH adjustment to 7.8 using NaOH and EDTA the aggregation step is frozen. The process proceeds with the reactor temperature being increased to achieve 85° C. At the desired temperature the pH is adjusted to 6.8 using pH 5.7 sodium acetate/acetic acid buffer where the particles begin to coalesce. After about two hours the particles achieve >0.965 and are quench-cooled using a heat exchanger. The toner is washed with three deionized water washes at room temperature and dried using an ALJET "THERMAJET" dryer Model 4.

EXAMPLE III

A pre-blend of about 1.9% 0.02M $HNO_3$, about 24.7% of a latex core including a styrene/n-butyl acrylate/β-carboxyethyl acrylate copolymer at a ratio of about 74:23:3, about 12.2% of a latex shell including a styrene/n-butyl acrylate/β-carboxyethyl acrylate copolymer at a ratio of about 74:23:3, about 6.7% NIPEX 35 carbon black available from Evonik Germany, having a surface level of 0.04 atomic percent sulfur as measured by XPS by the method described in Example I, and about 54.5% deionized water are injected into a twin-screw extruder (ZSK25, manufactured by Coperion) via a pressure pump for aggregation and coalescence. The length/diameter (L/D ratio) of the extruder is about 53 and the screw L/D ratio is about 54.16. The screw configuration has a conveying screw followed by neutral kneading elements, right hand kneading elements, neutral kneading blocks, left hand kneading elements, and small pitch conveying elements to control stress, strain, residence time, and pumping of the pre-blend materials. The feed rate is adjusted from about 48 g/min to about 97 g/min and temperature is from about 40-100° C. Screw speed varies from about 200-800 rpm. The size of the resin particles is measured using a FPIA2100 manufactured by Sysmex Corporation. Particle grow from an initial particle size of about 0.9μ to about 2.53μ. At a higher high screw speed and feed rate, better growth of particles occurs and the particles remain suspended.

EXAMPLE IV

A black developer composition is prepared as follows. 92 parts by weight of a styrene-n-butylmethacrylate resin, 6 parts by weight of NIPEX 35 carbon black available from Evonik Germany, having a surface level of 0.04 atomic percent sulfur as measured by XPS by the method described in Example I, and 2 parts by weight of cetyl pyridinium chloride are melt blended in an extruder wherein the die is maintained at a temperature of between about 130-145° C. and the barrel temperature ranges from about 80-100° C., followed by micronization and air classification to yield toner particles of a size of 12 p in volume average diameter. Subsequently, carrier particles are prepared by solution coating a HOEGANOES ANCHOR STEEL core with a particle diameter range of from about 75-150 microns, available from Hoeganoes Company, with 0.4 parts by weight of a coating comprising 20 parts by weight of VULCAN carbon black, available from Cabot Corporation, homogeneously dispersed in 80 parts by weight of a chlorotrifluoroethylene-vinyl chloride copolymer, commercially available as OXY 461 from Occidental Petroleum Company, which coating is solution coated from a methyl ethyl ketone solvent. The black developer is then prepared by blending 97.5 parts by weight of the coated carrier particles with 2.5 parts by weight of the toner, in LODIGE BLENDER about 10 minutes, resulting in a developer with a toner exhibiting a positive triboelectric charge.

EXAMPLE V

A heat fusible microencapsulated toner is prepared by the following procedure. Into a 250 mL polyethylene bottle is added 15.3 g styrene monomer, 61.3 g n-butyl methacrylate monomer, 22.4 g copolymer comprising about 52 wt. % styrene and 48 wt. % n-butyl methacrylate, and 21.0 g mixture of NIPEX 35 carbon black available from Evonik Germany, having a surface level of 0.04 atomic percent sulfur as measured by XPS by the method described in Example I, predispersed into a styrene/n-butyl methacrylate copolymer comprising 65 wt. % styrene and 35 wt. % n-butyl methacrylate, wherein the pigment to copolymer ratio is 50/50 by weight. The polymer and pigment are dispersed into the monomer for 24-48 h on a BURRELL wrist shaker. Once the pigmented monomer solution was homogeneous, into the mixture is dispersed 19.0 g terephthaloyl chloride, 3.066 g 2,2'-azobis (2,4-dimethylvaleronitrile), and 0.766 g 2,2'-azobisisobutyronitrile by shaking the bottles on a BURRELL wrist shaker for 10 min. Into a stainless steel 2L beaker containing 600 mL 0.5% polyvinylalcohol solution, Mw 96,000, 88% hydrolyzed, and 0.1% sodium dodecyl sulfate is dispersed the pigmented monomer solution with a BRINKMANN PT45/80 homogenizer and PTA-35/4G probe at 10,000 rpm for 3 min. The dispersion is performed in a cold water bath at 15° C. Subsequently, the dispersion is transferred into 2 L glass reactor equipped with a mechanical stirrer and an oil bath under the beaker. While stirring the solution vigorously, an aqueous solution of 11.0 g 1,6-hexanediamine, 13.0 g sodium carbonate, and 100 mL distilled water is poured into the reactor and the mixture is stirred for 2 h at room temperature. During this time, the interfacial polymerization occurs to form a noncrosslinked polyamide shell around the core material. While still stirring, the volume of the reaction mixture is increased to 1.5 L with 1.0% polyvinylalcohol solution, and an aqueous solution containing 1.0 g potassium iodide dissolved in 10.0 mL distilled water is added. The pH of the solution is adjusted to pH 7-8 with dilute hydrochloric acid and then heated for 12 h at 85° C. while still stirring. During this time the monomeric material undergoes free radical polymerization to complete formation of the polymeric core. The solution is then cooled to room temperature and washed 10 times with distilled water by settling the particles by gravity. The particles are screened wet through 425 and 250 p sieves and then spray dried.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. A process for preparing toner particles which comprises:
(a) selecting a carbon black;
(b) measuring the surface level of sulfur of the carbon black by X-ray Photoelectron Spectroscopy to ensure that the surface level of sulfur is no more than about 0.05 atomic percent;
(c) mixing the carbon black with a resin to generate a toner composition; and
(d) forming toner particles from the toner composition.

2. A process according to claim 1 wherein the carbon black has an average particle diameter of from about 100 nm to about 300 nm.

3. A process according to claim 1 wherein the surface level of sulfur of the carbon black as measured by X-ray Photoelectron Spectroscopy is no more than about 0.04 atomic percent.

4. A process according to claim 1 wherein the surface level of sulfur of the carbon black as measured by X-ray Photoelectron Spectroscopy is no more than about 0.03 atomic percent.

5. A process according to claim 1 wherein the toner particles are prepared by an emulsion aggregation process.

6. A process for preparing toner particles which comprises:
(a) selecting a carbon black;
(b) measuring the surface level of sulfur of the carbon black by X-ray Photoelectron Spectroscopy to ensure that the surface level of sulfur is no more than about 0.05 atomic percent;
(c) generating polyester latex particles by melt mixing a polyester resin in the absence of an organic solvent, optionally adding a surfactant to the resin, and adding to the resin a basic agent and water to form an emulsion of resin particles;
(d) mixing the carbon black with the polyester latex particles by an emulsion aggregation process to generate a toner composition; and
(e) forming toner particles from the toner composition.

7. A process according to claim 6 wherein the carbon black has an average particle diameter of from about 100 nm to about 300 nm.

8. A process according to claim 6 wherein the surface level of sulfur of the carbon black as measured by X-ray Photoelectron Spectroscopy is no more than about 0.04 atomic percent.

9. A process according to claim 6 wherein the surface level of sulfur of the carbon black as measured by X-ray Photoelectron Spectroscopy is no more than about 0.03 atomic percent.

10. A process according to claim 6 wherein a surfactant is added to the resin.

11. A process according to claim 6 wherein, subsequent to adding to the resin a basic agent and water to form an emulsion of resin particles, the emulsion has a pH of from about 5 to about 11.

12. A process for preparing toner particles which comprises:

(a) selecting a carbon black;

(b) measuring the surface level of sulfur of the carbon black by X-ray Photoelectron Spectroscopy to ensure that the surface level of sulfur is no more than about 0.05 atomic percent;

(c) generating polyester latex particles by:

(i) providing at least one polyester resin possessing at least one acid group in a reaction vessel;

(ii) neutralizing the at least one acid group by contacting the resin with a base;

(iii) adding water and emulsifying the neutralized resin by contacting the neutralized resin with at least one surfactant in the absence of an organic solvent to provide a latex emulsion containing latex particles; and (iv) continuously recovering the latex particles;

(d) mixing the carbon black with the polyester latex particles by an emulsion aggregation process to generate a toner composition; and (e) forming toner particles from the toner composition.

13. A process according to claim 12 wherein the base is selected from ammonium hydroxide, potassium hydroxide, sodium hydroxide, sodium carbonate, sodium bicarbonate, lithium hydroxide, potassium carbonate, triethyl amine, triethanolamine, pyridine, diphenylamine, poly(ethylene amine), or mixtures thereof.

14. A process according to claim 12 wherein the carbon black has an average particle diameter of from about 100 nm to about 300 nm.

* * * * *